United States Patent [19]

Chang et al.

[11] Patent Number: 4,937,123

[45] Date of Patent: Jun. 26, 1990

[54] PROCESS FOR PROVIDING POLYAMIDE MATERIALS WITH STAIN RESISTANCE

[75] Inventors: John C. Chang, New Brighton; Maynard H. Olson, North St. Paul; Imelda A. Muggli, St. Paul, all of Minn.

[73] Assignee: Minnesota Mining and Manufacturing Company, St. Paul, Minn.

[21] Appl. No.: 471,701

[22] Filed: Jan. 29, 1990

Related U.S. Application Data

[63] Continuation of Ser. No. 166,884, Mar. 11, 1988, abandoned.

[51] Int. Cl.[5] ..... B05D 3/02; B32B 7/00; C14C 9/00

[52] U.S. Cl. ..... 428/96; 8/115.54; 8/115.6; 252/8.57; 252/8.6; 252/8.8; 427/393.4; 428/267; 524/556

[58] Field of Search ..... 8/115.54, 115.6; 252/8.57, 8.6, 8.8; 427/393.4; 428/96, 267; 524/556

[56] References Cited

U.S. PATENT DOCUMENTS

| | | | |
|---|---|---|---|
| 2,205,883 | 6/1940 | Graves | 149/5 |
| 3,408,319 | 10/1968 | Raw | 260/23 |
| 3,961,881 | 6/1976 | Sumner et al. | 8/17 |
| 3,994,744 | 11/1976 | Anderle et al. | 134/4 |
| 4,081,383 | 3/1978 | Warburton et al. | 252/8.6 |
| 4,203,859 | 5/1980 | Kirn et al. | 252/174.23 |
| 4,334,876 | 6/1982 | Beier et al. | 8/94.19 |
| 4,388,372 | 6/1983 | Champaneria et al. | 428/395 |
| 4,448,839 | 5/1984 | Morris | 427/393.4 X |
| 4,507,324 | 3/1985 | Olive et al. | 427/343.4 X |
| 4,526,581 | 7/1985 | Prentiss et al. | 8/94.33 |
| 4,699,812 | 10/1987 | Mank et al. | 427/393.4 |
| 4,822,373 | 4/1989 | Olson et al. | 8/115.5 X |

FOREIGN PATENT DOCUMENTS

| | | |
|---|---|---|
| 235980 | 2/1987 | European Pat. Off. . |
| 235989 | 2/1987 | European Pat. Off. . |

OTHER PUBLICATIONS

*Sulfonated and Related Reactions*, E. E. Gilbert, Interscience Publishers, 1965.

*Phenolic Resins*, A. Knopf et al., Springer-Verlag, 1985.

*Primary Examiner*—Michael Lusignan

*Attorney, Agent, or Firm*—Donald M. Sell; Walter N. Kirn; Carole Truesdale

[57] ABSTRACT

A method for imparting to fibrous polyamide materials stain resistance to acid colorants is provided. The method comprises contacting the fibrous polyamide materials with an aqueous treating solution comprising polymethacrylic acid, copolymers of methacrylic acid, or combinations thereof, and drying said substrate, said polymethacrylic acid, copolymers of methacrylic acid, or combinations thereof being provided in a sufficient amount and having a solubility and molecular weight such that said fibrous polyamide substrate has an improved acid colorant stain resistance.

8 Claims, 1 Drawing Sheet

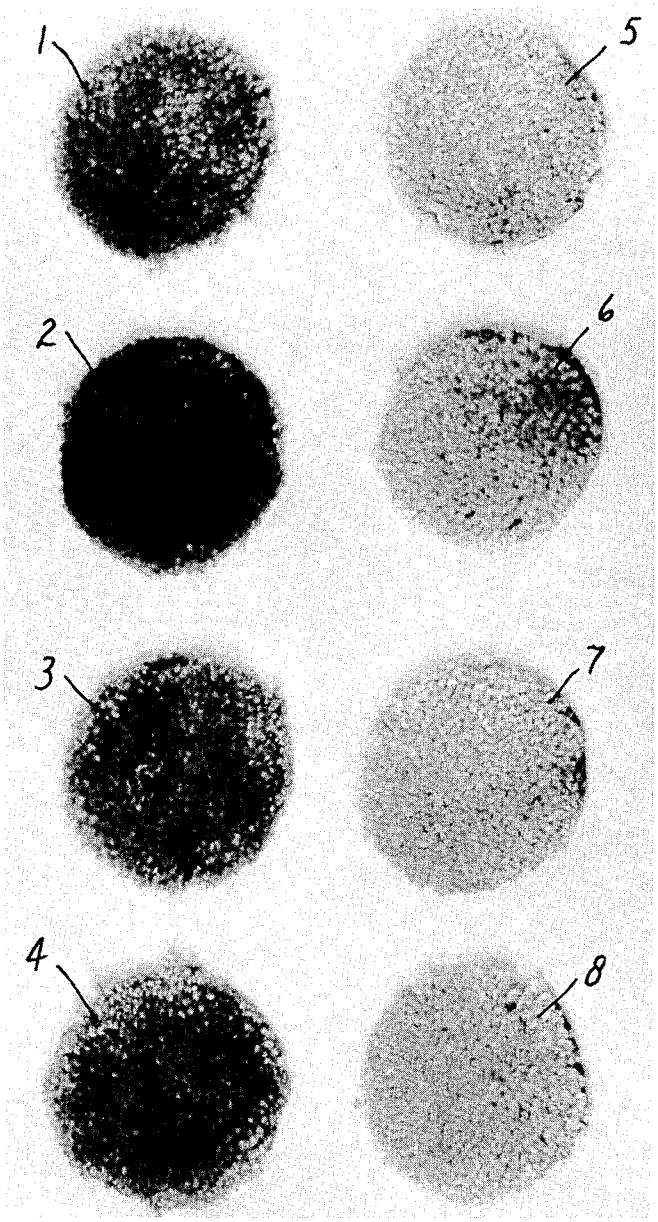
1
5
2
6
3
7
4
8

PROCESS FOR PROVIDING POLYAMIDE MATERIALS WITH STAIN RESISTANCE

This is a continuation of application Ser. No. 166,884, filed Mar. 11, 1988, now abandoned.

This invention relates to a process for providing fibrous polyamide materials such as nylon carpet with stain resistance and to fibrous polyamide materials so treated.

Fibrous polyamide articles such as nylon carpets are particularly susceptible to staining by natural and artificial acid colorants such as are commonly found in many foods and beverages. A need has long been felt for processes for economically providing such fibrous polyamide articles with resistance to staining by acid colorants. Particularly desirable are processes by which durable stain resistance can be imparted to fibrous polyamide articles during conventional processing and treating operations.

U.S. Pat. No. 3,961,881 (Sumner et al.) discloses a process for coloring synthetic polyamide textile materials which comprises applying to the textile materials by a dyeing, padding or printing process, an aqueous dispersion of pH less than 7 of a disperse dyestuff containing at least one carboxylic acid group and in the presence of a tanning agent, whereby level colorations are obtained which have excellent wet fastness properties. As set forth by Sumner et al., examples of natural agents include tannic acid and the vegetable tannins, while synthetic agents include condensation products of naphthols, naphthalene sulphonic acids and formaldehyde, condensation products of phenol, naphthalene, formaldehyde and sulphuric acid, condensation products of dihydroxydiphenylsulphone and formaldehyde, condensation products of dihydroxydiphenylsulphone sulphonic and aliphatic aldehydes, condensation products of sulphurized phenols, naphthalene and formaldehyde. U.S. Pat. No. 2,205,883 (Graves) discloses tanning agents which are the acidic polymerization products of the polymerization of methacrylic acid with itself as well as interpolymerization of methacrylic acid with other materials.

U.S. Pat. No. 3,408,319 (Rau) discloses tanning compositions which are made by copolymerization of a mixture of (A) methacrylic acid, acrylic acid or mixtures of such acids with (B) a sulfated unsaturated oil. The unsaturated acid used is preferably 75 to 100% methacrylic acid and 25 to 0% respectively of acrylic acid, and generally the use of methacrylic acid exclusively is most practical from the standpoint of cost and effectiveness. The amount of sulfonated oil is from 10 to 25% by weight of the acid monomer.

U.S. Pat. No. 3,994,744 (Anderle et al.) discloses aqueous cleaning compositions having a minimum film-forming temperature of at least 30° C. and comprising a polymer having a glass transition temperature of at least 35° C. and a metal salt, form a tacky film after being applied to a soiled substrate. Soil adheres to the tacky film which, as a result of the drying of said composition, fractures to form a removable residue. The compositions contain polymers preferably derived from a carboxylic acid monomer and a soft monomer and/or a hard monomer. Preferred soft monomers are vinyl acetate and the alkyl esters of acrylic acid wherein the alkyl group contains from 1–12 carbon atoms. Suitable hard monomers include lower alkyl methacrylates wherein the lower alkyl group contains 1–3 carbon atoms, cycloalkyl acrylates and methacrylates wherein the cycloalkyl group contains 5–7 carbon atoms, and hard vinyl monomers. examples of acid monomer include acrylic, methacrylic, itaconic, maleic and crotonic acids and monoalkyl esters of itaconic and maleic acids wherein the alkyl group contains 1–8 carbon atoms.

U.S. Pat. No. 4,081,383 (Warburton, Jr. et al.) discloses an anti-soiling treatment for carpets and carpet yarns. The carpets or carpet yarns prior to carpet manufacture are coated with a polymeric material containing either (A) a blend of a methacrylic acid emulsion copolymer and an epoxy resin or (B) a methacrylic acid emulsion copolymer having epoxy monomer units therein. The copolymer in either case contains 40–75% by weight methacrylic acid and the glass transition temperature of cured coatings of the polymeric material is at least 50° C.

U.S. Pat. No 4,334,876 (Beier et al.) discloses a process for producing leather wherein leather stock is subjected to a multiple-stage tanning process involving a first treatment with an aqueous dispersion or solution of a synthetic polymeric composition made by polymerizing at least one member selected from the group consisting of acrylic acid and methacrylic acid and, optionally, one or more polymerizable compounds selected from the group of alkyl esters of acrylic acid, alkyl esters of methacrylic acid and sulfated unsaturated drying oils, followed by a second treatment with a zirconium tanning compound having a 0–45% basicity by the Schorlemmer scale.

U S. Pat. No. 4,388,372 (Champaneria et al.) discloses a durable antisoiling coating composition for textile filaments comprising a perfluoroalkyl ester of a citric acid urethane and fluorinated alcohols in combination with a modified epoxy resin which is the reaction product of a carboxyl-functional vinyl polymer, an epoxy resin and a tertiary amine. Preferred vinyl resins for use in making the modified epoxy resin reaction product are the terpolymers of styrene/ethyl acrylate/methacrylic acid, and particularly such terpolymers wherein the monomers are in a mol ratio to one another respectively of about 1:1:2.

U.S. Pat. No. 4,526,581 (Prentiss et al.) discloses a process for producing leather which employs a copolymer tanning agent comprising at least 60 mole percent residues of methacrylic acid and at least about 5 mole percent of residues of at least one alkyl acrylate selected from methyl, ethyl, propyl, and butyl acrylates, the copolymer having a weight average molecular weight from about 3,500 to 9,000.

U.S. Pat. No. 4,699,812 (Munk et al.) discloses a method for imparting stain resistance to fibers containing free amino groups, and especially polyamide fibers, by contacting the fiber with a solution of an aliphatic sulfonic acid containing 8 to 24 carbon atoms under acidic conditions.

The present invention, in one aspect, provides a method for imparting to fibrous polyamide materials stain resistance to acid colorants comprising contacting the fibrous polyamide materials with an aqueous treating solution comprising polymethacrylic acid, copolymers of methacrylic acid, or combinations thereof, and drying said substrate, said polymethacrylic acid, copolymers of methacrylic acid, or combinations thereof being provided in a sufficient amount and having a solubility and molecular weight such that said fibrous polyamide substrate has an improved acid colorant stain resistance. Generally, a rating of at least 5 is satisfactory, a rating of 7 is good, and a rating of 8 is excellent when the treated substrate is tested according to the test method set forth hereinafter, which test method challenges the substrate with an aqueous solution of FD&C Red Dye No. 40, a common stain test solution.

The present invention, in another aspect, provides fibrous polyamide substrates treated with an aqueous treating solution comprising polymethacrylic acid, copolymers of methacrylic acid, or combinations thereof, said polymethacrylic acid, copolymers of methacrylic acid, or combinations thereof being provided in a sufficient amount and having a solubility and molecular weight such that said fibrous polyamide substrate has an improved acid colorant stain resistance. Generally, a rating of at least 5 is satisfactory, a rating of 7 is good, and a rating of 8 is excellent.

The present invention, in a further aspect, provides an aqueous solution useful in imparting stain resistance to acid colorants to fibrous polyamide materials, the solution comprising polymethacrylic acid, copolymers of methacrylic acid, or combinations thereof, said polymethacrylic acid, copolymers of methacrylic acid, or combinations thereof being provided in a sufficient amount and having a solubility and molecular weight such that said solution is capable of providing said fibrous polyamide substrate with an improved acid colorant stain resistance. Generally, a rating of at least 5 is satisfactory, a rating of 7 is good, and a rating of 8 is excellent.

The FIGURE shows a photograph of carpet samples tested for stain resistance according to the test method set forth hereinafter.

The polymethacrylic acid, copolymers of methacrylic acid, or combinations thereof useful in the present invention are preferably hydrophilic. As used herein, the term "methacrylic polymer", is intended to include the polymethacrylic acid homopolymer as well as polymers formed from methacrylic acid and one or more other monomers. The monomers useful for copolymerization with the methacrylic acid are monomers having ethylenic unsaturation. Such monomers include, for example, monocarboxylic acids, polycarboxylic acids, and anhydrides; substituted and unsubstituted esters and amides of carboxylic acids and anhydrides; nitriles; vinyl monomers; vinylidene monomers; monoolefinic and polyolefinic monomers; and heterocyclic monomers.

Representative monomers include, for example, acrylic acid, itaconic acid, citraconic acid, aconitic acid, maleic acid, maleic anhydride, fumaric acid, crotonic acid, cinnamic acid, oleic acid, palmitic acid, vinyl sulfonic acid, vinyl phosphonic acid, alkyl or cycloalkyl esters of the foregoing acids, the alkyl or cycloalkyl groups having 1 to 18 carbon atoms such as, for example, ethyl, butyl, 2-ethylhexyl, octadecyl, 2-sulfoethyl, acetoxyethyl, cyanoethyl, hydroxyethyl and hydroxypropyl acrylates and methacrylates, and amides of the foregoing acids, such as, for example, acrylamide, methacrylamide, methylolacrylamide, and 1,1-dimethylsulfoethylacrylamide, acrylonitrile, methacrylonitrile, styrene, α-methylstyrene, p-hydroxystyrene, chlorostyrene, sulfostyrene, vinyl alcohol, N-vinyl pyrrolidone, vinyl acetate, vinyl chloride, vinyl ethers, vinyl sulfides, vinyl toluene, butadiene, isoprene, chloroprene, ethylene, isobutylene, vinylidene chloride, sulfated castor oil, sulfated sperm oil, sulfated soybean oil, and sulfonated dehydrated castor oil. Particularly useful monomers include, for example, alkyl acrylates having 1–4 carbon atoms, itaconic acid, sodium sulfostyrene, and sulfated castor oil. Of course, mixtures of the monomers, such as, for example, sodium sulfostyrene and styrene, and sulfated castor oil and acrylic acid, can be copolymerized with the methacrylic acid.

The methacrylic polymers useful in the present invention can be prepared using methods well-known in the art for polymerization of ethylenically unsaturated monomers.

Preferably, the methacrylic acid comprises about 30 to 100 weight percent, more preferably 60 to 90 weight percent, of the methacrylic polymer. The optimum proportion of methacrylic acid in the polymer is dependent on the comonomer used, the molecular weight of the polymer, and the pH at which the material is applied. When water-insoluble comonomers, such as ethyl acrylate are copolymerized with the methacrylic acid, they may comprise up to about 40 weight percent of the methacrylic polymers. When water-soluble monomers, such as acrylic acid or sulfoethyl acrylate are copolymerized with the methacrylic acid, the water-soluble comonomers preferably comprise no more than 30 weight percent of the methacrylic polymer and preferably the methacrylic polymer also comprises up to about 50 weight percent water-insoluble monomer.

Generally, the methacrylic polymer should be sufficiently water-soluble that uniform application and penetration of the polymer into the fiber surface can be achieved. However, when the polymer is excessively water soluble, acid colorant stain resistance and durability to cleaning may be reduced.

The glass transition temperature of the polymer can be as low as about 35° C., although higher glass transition temperatures are preferred. When polymer having high glass transition temperatures, i.e., as high as 230° C. or higher, are used, an additional benefit of improved soil resistance of the fibrous polyamide substrate can be obtained.

The weight average molecular weight and the number average molecular weight of the methacrylic polymer should be such that satisfactory stain resistance is provided by the polymer. Generally, the lower 90 weight percent of the polymer material preferably has a weight average molecular weight in the range of about 2500 to 250,000, more preferably in the range of about 3000 to 100,000. Generally, the lower 90 weight percent of the polymer material preferably has a number average molecular weight in the range of about 500 to 20,000, more preferably in the range of about 800 to 10,000. Generally, more water-soluble comonomers are preferred when the molecular weight of the polymer is high and less water-soluble or water-insoluble comonomers are preferred when the molecular weight of the polymer is low.

Commercially available methacrylic polymers generally useful in the present invention include Leukotan TM 970, Leukotan TM 1027, Leukotan TM 1028, and Leukotan TM QR 1083, available from Rohm and Haas Co.

The amount of the methacrylic polymer used should be sufficient to provide the desired degree of stain resistance to the polyamide substrate. Generally, when the substrate is nylon 66, lower application levels can be used than when the substrate is nylon 6 or wool. When the polyamide material is heat-set carpet yarn, yarn heat-set under moist conditions, e.g., in an autoclave, generally requires higher application levels than yarn heat-set under substantially dry conditions. Preferably, the amount of methacrylic polymer used is at least about 0.1 weight percent, more preferably at least about 0.5 weight percent, most preferably at least about 1 weight percent, based on the weight of the fiber when the fiber is nylon 66 carpet fiber. Preferably, the amount of methacrylic polymer used is at least about 0.5, more preferably at least about 1 weight percent, based on the weight of the fiber when treating nylon 6 carpet fiber.

Generally, the methacrylic polymer is applied from an aqueous solution. The pH of the solution is preferably below about 7, more preferably below about 5. Generally, amounts of methacrylic polymer in excess of 3 weight percent owf provide little added benefit and may cause the fiber to have a harsh hand.

The methacrylic polymer can be applied from an aqueous exhaust bath such as is used in beck dyeing of carpet. The methacrylic polymer can be added to the aqueous dye bath solution and exhausted concurrently with the dye. Generally, the dye bath is maintained at a temperature at or near the boiling point for a period of 10 to 90 minutes or more to effect exhaustion of the dye and the methacrylic polymer.

Alternatively, the methacrylic polymer can be added to the aqueous dye bath after exhaustion of the dye or the dye bath can be drained and fresh water added prior to the addition of the methacrylic polymer. Generally, the bath is maintained at a temperature at or near boiling for a period of time sufficient to exhaust the methacrylic polymer, usually 10 to 90 minutes.

The methacrylic polymer can be applied during continuous dyeing, such as with Kuster TM or Otting TM carpet dyeing equipment. The methacrylic polymer can be added directly to the aqueous dye solution and the solution is conventionally applied to the polyamide carpet. Alternatively, the methacrylic polymer can be applied during a wetting out step prior to application of the dye.

The methacrylic polymer can also be applied to polyamide material by a padding operation. This can be done as a separate step or in conjunction with the application of various convention finishes such as wetting agents, softeners, and leveling agents. After application of the solution, the polyamide material is conventionally dried.

The methacrylic polymer can also be applied by foam techniques which are well-known in the art. Generally, the methacrylic polymer is applied from an aqueous solution which may further contain a foaming agent The foaming agents used are those typically used in foam dyeing.

The methacrylic polymer can also be applied to polyamide fabrics by other methods well known to those skilled in the art. Other suitable methods include application by padding, low-pressure padding such as can be accomplished with Kuster Flexnip TM equipment, spray applicators such as those available from Otting International, or dip boxes which need not be equipped with moisture reduction apparatus such as squeeze rolls. The methacrylic polymer is generally applied in these methods from an aqueous solution at ambient conditions followed by steaming for from 15 to 180 seconds, then drying or from an aqueous solution at elevated temperatures, e.g., 60° C. to 90° C., followed by skying for 15 to 180 seconds, then drying.

The methacrylic polymer can also be applied to nylon carpet during carpet shampooing. Useful techniques include the use of scrubbing machines and steam or hot water cleaning machines.

Fluorochemical compositions for providing oil and water repellency can also be applied in conjunction with the methacrylic polymer. The fluorochemical composition can be added in an appropriate amount to the treating solution.

The following non-limiting examples serve to illustrate the invention. In the following examples, all ratios are by weight and percentages are weight percent unless otherwise indicated.

In the examples, the following staining test was used: A 6.5 g test sample of carpet, which has been dyed using a blue disperse dye with a 45 minute beck dyeing cycle, is immersed in 40 g of an aqueous solution containing 0.008 weight percent FD&C Red Dye No. 40 and 0.04 weight percent citric acid. The solution is allowed to remain on the test sample for eight hours at room temperature, i.e., about 22° C. The sample is rinsed under running tap water, dried and then evaluated for staining using a graduated rating scale which ranges from 1 to 8, as shown in the drawing where 1 represents no discernible removal of the red dye stain and 8 represents complete removal of the red dye stain. In general, an eight-hour stain resistance of at least 5 is satisfactory, at least 7 is good, and 8 is excellent.

PREPARATION OF METHACRYLIC POLYMER (POLYMER A)

To a reaction vessel equipped with a reflux condenser, a mechanical stirrer, and a thermometer, were charged 14 g sulfated castor oil (75% solids) and 95 g deionized water. This solution was heated to 90° C. and 1.2 g ammonium persulfate were added. To this solution were added simultaneously dropwise 47.6 g methacrylic acid, 11.9 g acrylic acid, and 5 g ammonium persulfate in 55 g water over a period of about 1 hour. The reaction mixture was further stirred for 90 minutes at 90° C. and then cooled to 50° C. The resultant copolymer solution was partially neutralized to pH 4.3 by the addition of 9.7 g 50% aqueous sodium hydroxide. The resultant product contained 39.3% copolymer solids.

Polymers B through K were prepared using a procedure similar to that used in the preparation of Polymer A using the monomers and reactant ratios set forth in Table 1.

TABLE 1

| Polymer | Reactant(s) | Reactant ratio |
|---|---|---|
| A | methacrylic acid | 68 |
| | sulfonated castor oil | 15 |
| | acrylic acid | 17 |
| B | methacrylic acid | 100 |
| C | methacrylic acid | 80 |
| | ethyl acrylate | 20 |
| D | methacrylic acid | 65 |
| | ethyl acrylate | 35 |
| E | methacrylic acid | 80 |
| | ethyl acrylate | 20 |
| F | methacrylic acid | 84 |
| | sulfated castor oil | 16 |
| G | methacrylic acid | 80 |
| | sodium sulfostyrene | 10 |
| | styrene | 10 |
| H | methacrylic acid | 81 |
| | sulfated castor oil | 10 |
| | ethyl acrylate | 9 |
| I | methacrylic acid | 68 |
| | sulfated castór oil | 15 |
| | acrylic acid | 17 |
| J | acrylic acid | 100 |
| K | acrylic acid | 70 |

TABLE 1-continued

| Polymer | Reactant(s) | Reactant ratio |
|---|---|---|
| | ethyl acrylate | 30 |

Polymer L was prepared by placing in a bottle 46 g water, 8 g methacrylic acid, 2 g sodium sulfostyrene, 0.3 g mercapto propionic acid, without regard to order, and finally 0.3 g potassium persulfate. The bottle was evacuated and purged three times with nitrogen. The bottle cap was tightened and the bottle placed in a water bath having a temperature of 72° C. under agitation for a period of 16 hours. The resulting polymer solution was clear and fluid with a polymer solids content of 19 weight percent.

Polymers M through Q were prepared using a procedure similar to that used in the preparation of Polymer L using the monomers and reactant ratios set forth in Table 2.

TABLE 2

| Methacrylic Polymer | Reactants | Reactant ratio |
|---|---|---|
| L | methacrylic acid | 80 |
| | sodium sulfostyrene | 20 |
| M | methacrylic acid | 50 |
| | sodium sulfostyrene | 50 |
| N | methacrylic acid | 80 |
| | itaconic acid | 20 |
| O | methacrylic acid | 80 |
| | vinyl acetate | 20 |
| P | methacrylic acid | 80 |
| | 1,1-dimethylsulfoethyl-acrylamide | 20 |
| Q | methacrylic acid | 80 |
| | hydroxyethyl acrylate | 20 |

Polymer R was prepared using the procedure used to prepare Polymer M except that the following ingredients were used: 92 g water, 16 g methacrylic acid, 2 g sodium sulfostyrene, 2 g styrene, 0.6 g mercapto propionic acid, 0.6 g sodium dodecyl benzene sulfonate, without regard to order, and finally 0.6 g ammonium persulfate. Polymer S was prepared according to the procedure set forth in Example 1 of U.S. Pat. No. 4,081,383.

The weight average molecular weight (Mw) and the number average molecular weight (Mn) of the lower 90 weight percent of various of the thus-prepared polymers were determined using a column bank having four Ultrahydrogel columns, i.e., linear, 1000, 500, and 250, available from Waters Assoc and polyacrylic acid standards available from American Polymer Standards Company The results are set forth in Table 3.

TABLE 3

| Polymer | Mw | Mn |
|---|---|---|
| B | 8,100 | 2,680 |
| C | 85,500 | 3,380 |
| D | 58,000 | 3,430 |
| E | 2,920,000 | 414,000 |
| F | 5,820 | 2,460 |
| H | 8,470 | 3,410 |
| J | 5,830 | 1,331 |
| K | 36,611 | 5,490 |
| S | 532,000 | 47,634 |

The weight average molecular weight and the number average molecular weight of the lower 90 weight percent of several commercially available methacrylic acid-based polymers, Leukotan TM 970, Leukotan TM 1027, Leukotan TM 1028, and Leukotan TM QR 1083, all available from Rohm and Haas Co. and an acrylic acid-based polymer, Leukotan TM LP 1042, also available from Rohm and Haas Co., were also determined. The results are set forth in Table 4.

TABLE 4

| Polymer | Mw | Mn |
|---|---|---|
| Leukotan TM 970 | 6,360 | 2,320 |
| Leukotan TM 1027 | 9,020 | 2,910 |
| Leukotan TM 1028 | 9,460 | 5,592 |
| Leukotan TM QR 1083 | 5,280 | 1,410 |
| Leukotan TM LP 1042 | 2,560 | 1,400 |

EXAMPLES 1-14 AND COMPARATIVE EXAMPLES C1-C4

In Example 1, a treating solution was prepared containing 0.35 g Polymer A solids in 92 g water with the pH adjusted to 4.0 using 20% aqueous formic acid. To simulate a continuous treatment process, the treating solution was poured into a dye press and heated to 80° C. A 23 g sample of dyed carpet prepared using nylon 6 fiber, available from BASF, which had been heat set under moist conditions was steamed for 2 minutes and then immersed in the treating solution for 1 minute with pressure being applied to ensure thorough penetration of the treating solution. The treated sample was put through squeeze rollers at 30 psi to remove excess liquid and then dried at 70° C. for 45 minutes and 130° C. for 10 minutes.

In Examples 2-14 and Comparative Examples C1-C4, nylon 6 carpet samples were prepared and treated as in Example 1 except the polymers used were as set forth in Table 5.

Each sample was evaluated for stain resistance, the results being set forth in Table 5.

TABLE 5

| Example | Polymer | Stain resistance |
|---|---|---|
| 1 | A | 7 |
| 2 | B | 6 |
| 3 | C | 7 |
| 4 | D | 7 |
| 5 | F | 7 |
| 6 | G | 7 |
| 7 | H | 8 |
| 8 | I | 7 |
| 9 | L | 6 |
| 10 | N | 6 |
| 11 | O | 5 |
| 12 | Q | 5 |
| 13 | R | 7 |
| 14 | P | 5 |
| C1 | E | 3 |
| C2 | J | 2 |
| C3 | K | 2 |
| C4 | M | 4 |

As can be seen from the data in Table 5, the polymers of the invention (Examples 1-14) provide satisfactory to excellent stain resistance to the moist heat-set nylon 6 carpet samples. Of the Comparative Examples, Comparative Example C1 which was treated with a high molecular weight methacrylic acid-based copolymer and Comparative Examples C2 and C3 which were treated with polyacrylic acid and an acrylic acid copolymer, respectively exhibit particularly poor stain resistance.

EXAMPLE 15 AND COMPARATIVE EXAMPLES C5 AND C6

Carpet samples were prepared as in Example 1 using carpet prepared from the moist heat-set nylon 6 fiber except that the samples were treated with the following commercially available polymers: Example 15—Leukotan TM 970, a methacrylic acid-based polymer, available from Rohm and Haas Co.; Comparative Example C5—Leukotan TM LP 1042, an acrylic acid-based polymer, available from Rohm and Haas Co ; and Comparative Example C6—Acrysol TM RM-5, an acrylic acid-based monomer, available from Rohm and Haas Company. Each sample was tested for stain resistance. The results are set forth in Table 6.

TABLE 6

| Example | Stain resistance |
|---|---|
| 15 | 7 |
| C5 | 3 |
| C6 | 2 |

As can be seen from the data in Table 6, the methacrylic acid-based Leukotan TM 970 provided good stain resistance, while the acrylic acid-based Leukotan TM LP 1042 and Acrysol TM RM-5 provided very little stain resistance.

COMPARATIVE EXAMPLES C7 AND C8

In Comparative Example C7, a polymer of methacrylic acid, styrene, and methyl methacrylate was prepared substantially following the teachings of U.S. Pat. No. 4,081,383 (Warburton, Jr. et al.), Example 1.

A mixture of 69 parts methacrylic acid, 27 parts styrene and 5 parts methyl methacrylate was added to 80 parts of water containing 0.07 parts of 80% active isopropylbenzenehydroperoxide, 1.13 parts sodium dodecylbenzenesolfonate, 0.0375 parts of the sodium salt of ethylene diamine tetraacetic acid, and 0.0135 parts if $FeSO_4.7H_2O$. The resulting emulsion was degassed by stirring under nitrogen for 30 minutes. Then, 0.0104 parts of sodium sulfoxylate formaldehyde in 1.15 parts of water was added. The temperature rose from 24° C. to 50° C. over 18 minutes. Then 0.08 parts of 80% active isopropylbenzenehydroperoxide and 0.0104 parts of sodium sulfoxylate formaldehyde in 1.15 parts water were added. The lower 90 weight percent of the resulting polymer had a weight average molecular weight of 532,000 and a number average molecular weight of 47,600.

A carpet sample was prepared as in Example 1 using carpet prepared from the moist heat-set nylon 6 fiber except that the sample was treated with the above-prepared Warburton, Jr. et al. polymer. The sample was tested for stain resistance and received a rating of only 2, showing poor stain resistance.

In Comparative Example C8, 200 parts of the above-prepared polymer as a 20% solids aqueous solution were added to a Waring TM blender and agitated. Epoxy resin (DER TM 736, available from Dow Chemical Company) was then added (8 parts) slowly over several minutes. The blend was diluted to 23% solids.

A carpet sample was prepared as in Example 1 using carpet prepared from the moist heat-set nylon 6 fiber except that the sample was treated with the above-prepared copolymer/epoxy resin. The sample was tested for stain resistance and received a rating of only 2, showing poor stain resistance.

EXAMPLES 16–18

In Example 16, a solution containing 75 g/l Leukotan TM 970, and 10 g/l Alkafoam D, a foaming agent available from Alkaril Chemicals, Inc., was prepared and foamed onto a sample of carpet prepared from nylon 66 yarn heat set under moist conditions using a Gaston County laboratory FFT model foam finishing machine, available from Gaston County Dyeing Machine Company, using a 60:1 blow ratio and a wet pickup rate of 20% to provide an application rate of 0.5% Leukotan TM 970 based on the weight of the carpet. The sample was dried at 120° C. for 20 minutes.

In Examples 17 and 18, carpet samples were treated as in Example 15 except Polymer H and Polymer C, respectively were substituted for the Leukotan TM 970.

The treated samples were tested for stain resistance. The results are set forth in Table 7.

TABLE 7

| Example | Stain resistance |
|---|---|
| 16 | 6.5 |
| 17 | 7 |
| 18 | 5 |

As can be seen from the data in Table 7, the polymers of the invention provide adequate to good stain resistance to nylon carpet prepared from moist heat-set nylon 66 carpet fiber.

EXAMPLES 19–22 AND COMPARATIVE EXAMPLES C9–C11

In Example 19, a treating bath was prepared containing 0.69 g Polymer B solids in 690 g water with the pH adjusted to 3.5 using 20% aqueous formic acid. A 23 g sample of dyed carpet prepared using nylon 6 fiber, available from BASF, which had been heat set under moist conditions was steamed for 2 minutes and then placed in the treating bath. Under agitation, the temperature was raised to 70° C. over 30 minutes and held at 70° C. for 15 minutes. The sample was removed from the bath, put through squeeze rolls at 30 psi, and then dried at 70° C. for 45 minutes and 130° C. for 10 minutes.

In Examples 20–22 and Comparative Examples C9–C11, samples of carpet were treated as in Example 19 except the polymer set forth in Table 8 were substituted for Polymer B.

The treated samples were tested for stain resistance. The results are set forth in Table 8.

TABLE 8

| Example | Polymer | Stain resistance |
|---|---|---|
| 19 | B | 7.5 |
| 20 | H | 8 |
| 21 | Leukotan TM 970 | 7 |
| 22 | C | 7.5 |
| C9 | Epoxy resin blend of Example C12 | 2 |
| C10 | K | 2.5 |
| C11 | Acrysol TM RM-5 | 2 |

As can be seen from the data in Table 8, the methacrylic polymers provide excellent stain resistance. The polymer/epoxy resin blend of Warburton, Jr. et al. and the acrylic acid-based polymers provide little stain resistance.

EXAMPLES 23–25

In Examples 23–25, carpet samples were treated as in Example 1 except that Leukotan TM 1027, Leukotan TM 1028, and Leukotan TM QR 1083, respectively, each a methacrylic acid-based polymer available from Rohm and Haas Co., were substituted for polymer A. The treated samples were tested for stain resistance. The results are set forth in Table 9.

TABLE 9

| Example | SR |
|---|---|
| 23 | 7 |
| 24 | 7 |
| 25 | 6 |

As can be seen from the data in Table 9, the Leukotan TM QR 1083 provided better than satisfactory stain resistance, while the Leukotan TM 1027 and the Leukotan TM 1028 provided good stain resistance.

EXAMPLES 26–28 AND COMPARATIVE EXAMPLES C12–C14

In Example 26, a treating bath was prepared containing 0.2 g Polymer B in 80 g water with pH adjusted to 3.5 using 20% aqueous formic acid. A 20 g sample of dyed carpet prepared using nylon 66 fiber which had been heat set under dry conditions was steamed for 2 minutes and then placed in the treating bath. Under agitation, the temperature was raised to 70° C. over 30 minutes and held at 70° C. for 15 minutes. The sample was removed from the bath, rinsed, put through squeeze rolls at 30 psi, and then dried at 70° C. for 45 minutes and 130° C. for 10 minutes.

In Examples 27–28 and Comparative Examples C12-C14, samples of carpet were treated as in Example 26 except the polymers set forth in Table 10 were substituted for Polymer B. The treated samples were tested for stain resistance. The results are set forth in Table 10.

TABLE 10

| Example | Polymer | Stain resistance |
|---|---|---|
| 26 | B | 8 |
| 27 | C | 8 |
| 28 | H | 8 |
| C12 | Polymer of Example C8 | 4 |
| C13 | J | 2 |
| C14 | K | 3 |

As can be seen from the data in Table 10, methacrylic polymers of the invention provide greater stain resistance than do acrylic acid-based polymers (Comparative Examples C13 and C14) when applied on nylon 66 carpet fiber. Further, the methacrylic acid copolymer used in Comparative Example C12 performs unsatisfactorily due to its high molecular weight.

The various modifications and alterations of this invention will be apparent to those skilled in the art without departing from the scope and spirit of this invention and this invention should not be restricted to that set forth herein for illustrative purposes.

What is claimed is:

1. A method for imparting to fibrous polyamide materials stain resistance to acid colorants comprising contacting the fibrous polyamide materials with an aqueous treating solution comprising polymethacrylic acid, copolymers of methacrylic acid, or combinations thereof, and drying said substrate, said copolymers of methacrylic acid comprise at least about 30 weight percent methacrylic acid and said polymethacrylic acid, copolymers of methacrylic acid, or combinations thereof having the lower 90 weight percent having a weight average molecular weight in the range of about 2500 to 250,000 and a number average molecular weight in the range of about 500 to 20,000 and being provided in a sufficient amount and having a solubility such that said fibrous polyamide substrate has an acid colorant stain resistance of at least 5.

2. The method of claim 1 wherein said aqueous treating solution comprises polymethacrylic acid.

3. The method of claim 1 wherein copolymer is a copolymer of methacrylic acid and a comonomer which is a monocarboxylic acid, a polycarboxylic acid, an anhydride, a substituted or unsubstituted ester or amide of a carboxylic acid or anhydride, a nitrile, a vinyl monomer, a vinylidene monomer, a monoolefinic or polyolefinic monomer, a heterocyclic monomer, or combinations thereof.

4. The method of claim 3 wherein said comonomer is alkyl acrylate having 1–4 alkyl carbon atoms, itaconic acid, sodium sulfostyrene, or sulfated castor oil.

5. The method of claim 3 wherein said copolymer is a terpolymer of methacrylic acid, sodium sulfostyrene, and styrene; methacrylic acid, sulfated castor oil, and acrylic acid; and methacrylic acid, ethyl acrylate, and sulfated castor oil.

6. The method of claim 1 wherein said substrate is nylon 66 fiber and said polymethacrylic acid and/or said copolymers of methacrylic acid are present in an amount of at least about 0.1 weight percent based on the weight of the polyamide fibrous substrate.

7. The method of claim 1 wherein said substrate is nylon 6 fiber and said polymethacrylic acid and/or said copolymers of methacrylic acid are present in an amount of at least about 0.5 weight percent based on the weight of the polyamide fibrous substrate.

8. Fibrous polyamide substrates treated with an aqueous treating solution comprising polymethacrylic acid, copolymers of methacrylic acid, or combinations thereof, said copolymers of methacrylic acid comprise at least about 30 weight percent methacrylic acid and said polymethacrylic acid, copolymers of methacrylic acid, or combinations thereof having the lower 90 weight percent having a weight average molecular weight in the range of about 2500 to 250,000 and a number average molecular weight in the range of about 500 to 20,000 and being provided in a sufficient amount and having a solubility such that said fibrous polyamide substrate has an acid colorant stain resistance of at least 5.

* * * * *